US012337220B1

(12) United States Patent
Curtin

(10) Patent No.: US 12,337,220 B1
(45) Date of Patent: Jun. 24, 2025

(54) EZEKIEL CHOKE TOOL

(71) Applicant: David Curtin, Overland Park, KS (US)

(72) Inventor: David Curtin, Overland Park, KS (US)

( * ) Notice: Subject to any disclaimer, the term of this patent is extended or adjusted under 35 U.S.C. 154(b) by 106 days.

(21) Appl. No.: 18/503,259

(22) Filed: Nov. 7, 2023

(51) Int. Cl.
*A63B 69/00* (2006.01)
*A44C 5/00* (2006.01)

(52) U.S. Cl.
CPC ..... *A63B 69/00* (2013.01); *A44C 5/0007* (2013.01); *A63B 2209/08* (2013.01); *A63B 2244/10* (2013.01)

(58) Field of Classification Search
CPC . A63B 69/00; A63B 2209/08; A63B 2244/10; A44C 5/0007
See application file for complete search history.

(56) References Cited

U.S. PATENT DOCUMENTS 4,026,549 A * 5/1977 Gunn ..... A63B 21/0552 482/44
4,088,315 A * 5/1978 Schemmel ..... G01G 19/52 482/84
4,095,587 A 6/1978 Ishikawa
4,601,474 A 7/1986 Lew
4,819,137 A * 4/1989 Hamilton ..... F41B 15/025 463/47.7
5,087,220 A * 2/1992 Cotita ..... F41B 15/00 2/338
5,946,728 A 9/1999 Tane
D630,018 S 1/2011 Konigsberg
8,935,940 B1 * 1/2015 Lough ..... A44C 5/0038 63/3.1
9,200,862 B1 * 12/2015 Turner ..... A44B 17/0023
11,272,765 B2 3/2022 Corelli
11,344,768 B1 * 5/2022 Stull ..... A63B 23/16
2003/0126888 A1 7/2003 Ulrich
2003/0172436 A1 * 9/2003 Thompson ..... F41B 15/00 2/170
2005/0144790 A1 * 7/2005 Stanley, Jr. ..... B25G 1/12 30/340
2011/0130207 A1 * 6/2011 Hasenyager ..... F41B 15/02 463/47.2
2012/0186297 A1 7/2012 Reichenberg
2013/0123024 A1 * 5/2013 Harris ..... F41B 15/02 463/47.2
2013/0213089 A1 * 8/2013 Gagne ..... A44C 5/0007 63/1.12
2015/0367158 A1 * 12/2015 Pretz ..... A63B 21/0557 482/129
2017/0122708 A1 * 5/2017 Gorinas ..... A44C 9/0061
2017/0340070 A1 * 11/2017 Bloch ..... A44C 15/0015
2018/0214742 A1 * 8/2018 Harrison ..... A63B 21/4017
2018/0307326 A1 * 10/2018 Hoggeg ..... G06F 1/16

FOREIGN PATENT DOCUMENTS

CA 1070770 1/1980

* cited by examiner

*Primary Examiner* — Sundhara M Ganesan
(74) *Attorney, Agent, or Firm* — Kyle A. Fletcher, Esq.

(57) ABSTRACT

The Ezekiel choke tool includes a bracelet. The bracelet may include a first segment, a second segment, a cord, and a plurality of magnets. The bracelet may be worn by a user on the user's first forearm to facilitate a technique of Brazilian Jiu Jitsu called the Ezekiel Choke. The bracelet may be adapted to be leveraged by the user to squeeze the opponent's throat between the user's first forearm and the user's second forearm. The bracelet may encircle the user's first forearm, held together by the plurality of magnets.

20 Claims, 7 Drawing Sheets

EZEKIEL CHOKE TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of martial arts accessories, more specifically, an Ezekiel choke tool.

Summary of Invention

The Ezekiel choke tool comprises a bracelet. The bracelet may comprise a first segment, a second segment, a cord, and a plurality of magnets. The bracelet may be adapted to be worn by a user on the user's first forearm to facilitate a technique of Brazilian Jiu Jitsu called the Ezekiel Choke. In a 'separated configuration', the second segment may detach from the first segment but may remain coupled to the first segment by the cord. The bracelet may be adapted to be leveraged by the user to squeeze the opponent's throat between the user's first forearm and the user's second forearm. In an 'attached configuration', the bracelet may encircle the user's first forearm, held together by the plurality of magnets.

An object of the invention is to provide a bracelet comprising a first segment and a second segment that separate and remain tethered via a cord.

Another object of the invention is to provide a bracelet that may be used to execute an Ezekiel choke when in a 'separated configuration'.

A further object of the invention is to provide a bracelet that may be worn around the forearm when in an attached configuration'.

Yet another object of the invention is to provide a plurality of magnetics within the bracelet to hold the first segment and second segment together.

These together with additional objects, features and advantages of the Ezekiel choke tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the Ezekiel choke tool in detail, it is to be understood that the Ezekiel choke tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the Ezekiel choke tool.

It is therefore important that the claims be regarded as including such equivalent construction insofar as they do not depart from the spirit and scope of the Ezekiel choke tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
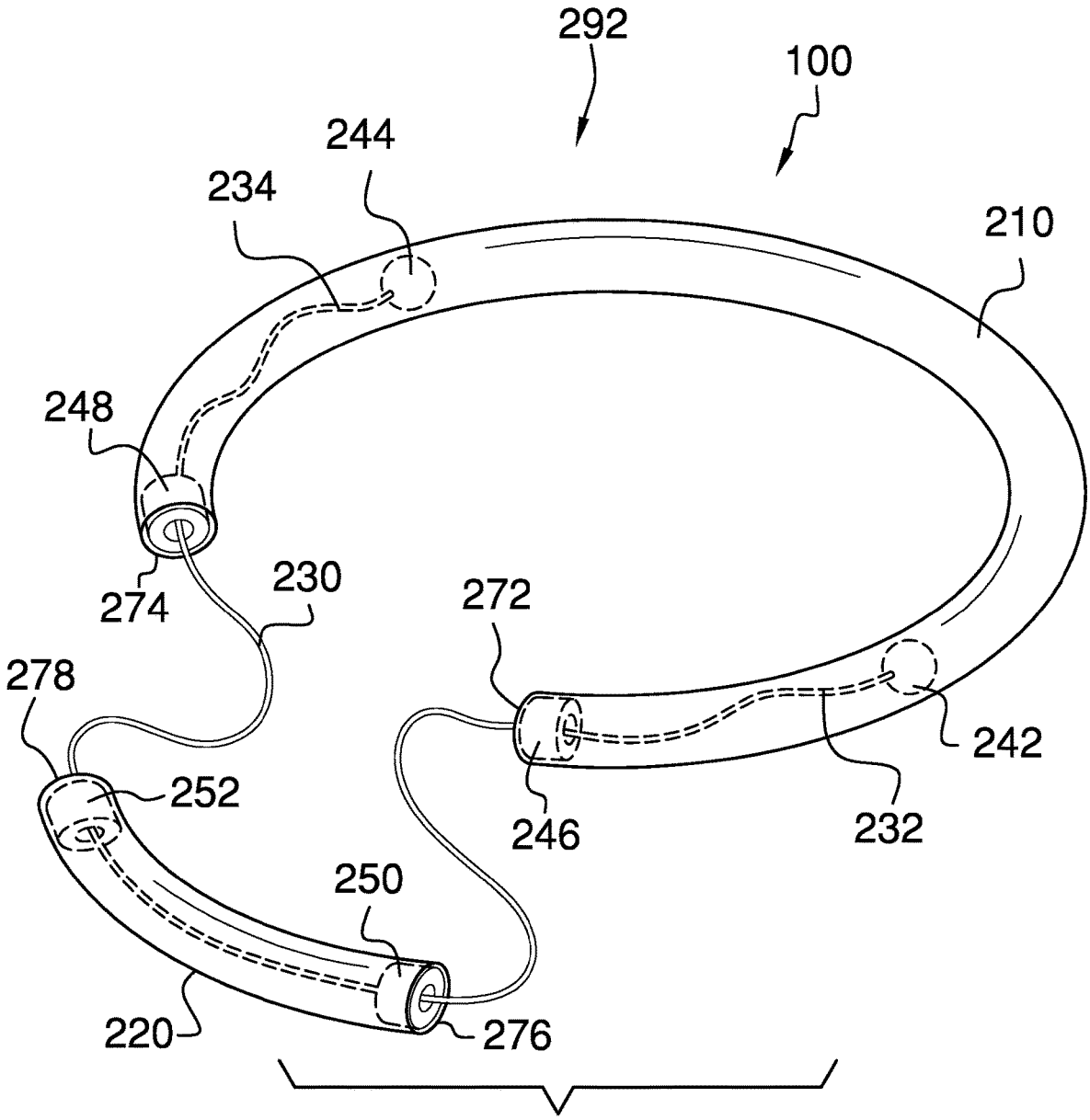
FIG. 1 is an isometric view of an embodiment of the disclosure, illustrating the 'separated configuration'.
Figure 2:
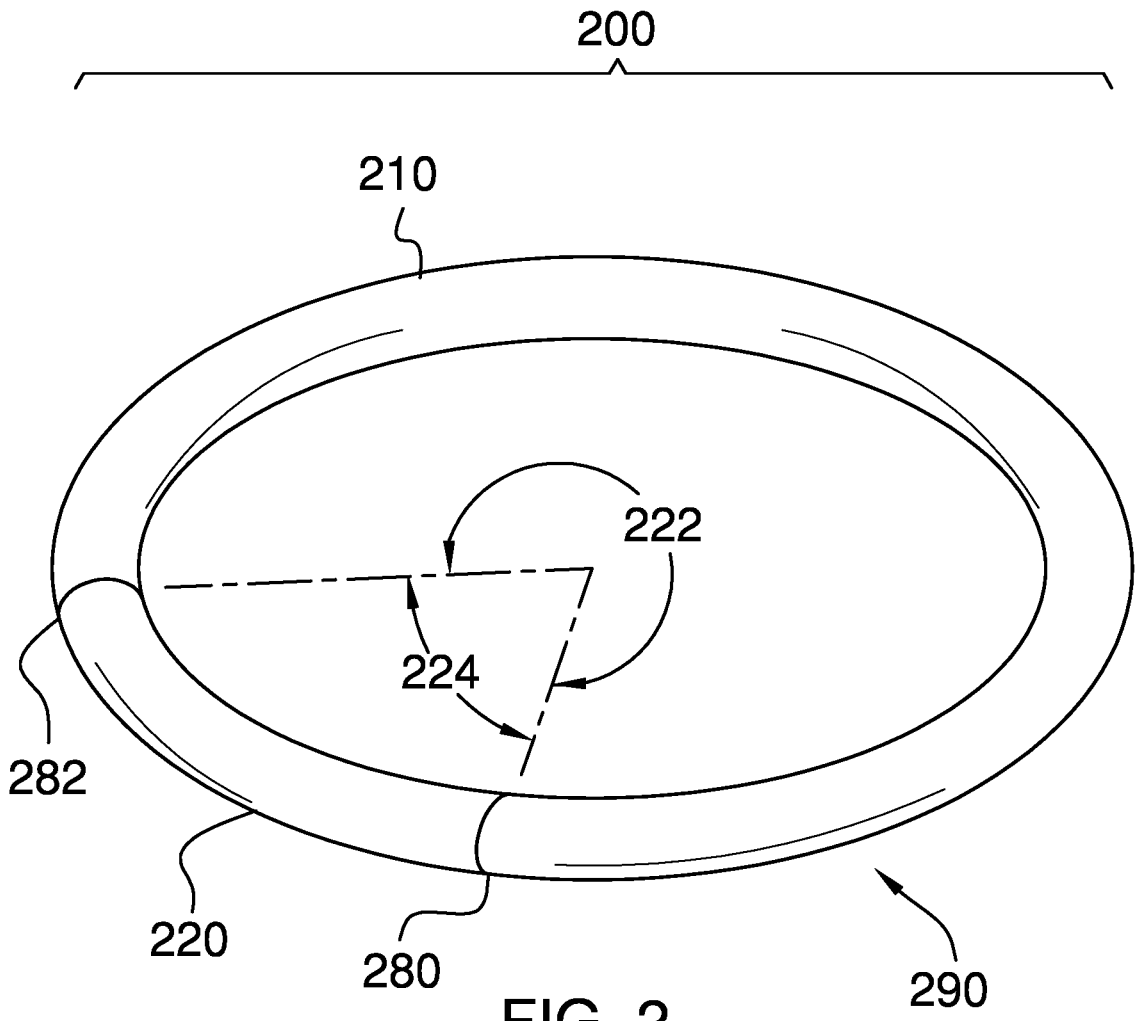
FIG. 2 is an isometric view of an embodiment of the disclosure, illustrating the 'attached configuration'.
Figure 3:
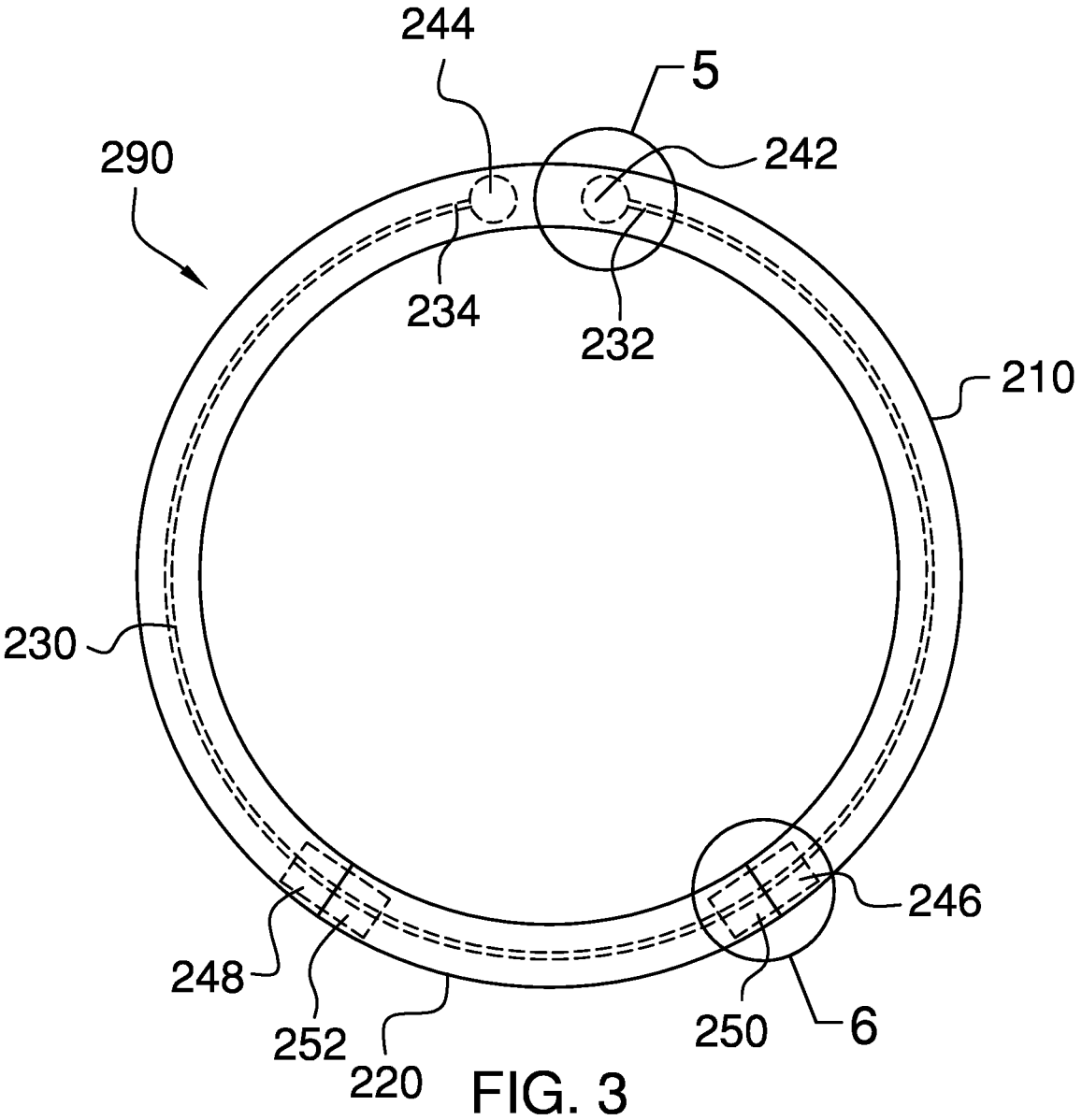
FIG. 3 is a top view of an embodiment of the disclosure, illustrating the 'separated configuration'.
Figure 4:
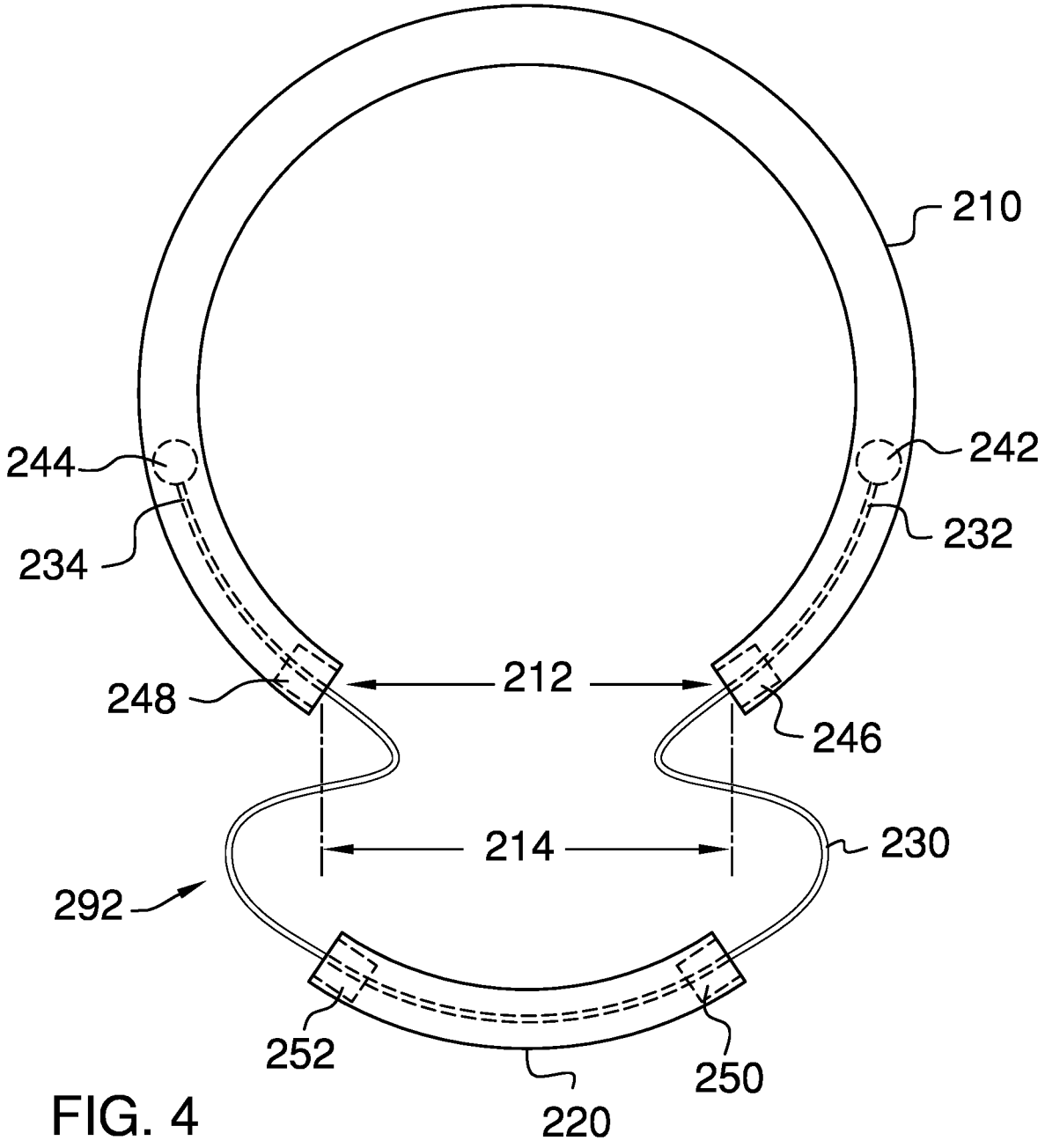
FIG. 4 is a top view of an embodiment of the disclosure, illustrating the 'attached configuration'.
Figure 5:
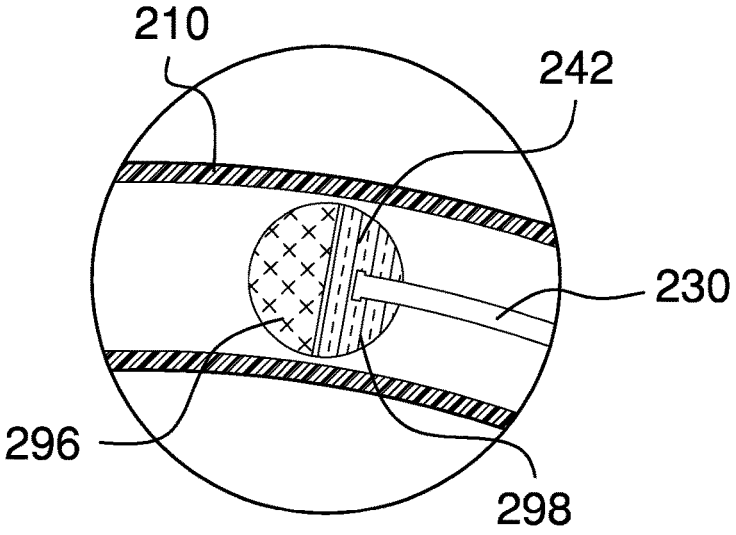
FIG. 5 is a detail view of an embodiment of the disclosure, illustrating the area marked 5 in FIG. 3.
Figure 6:
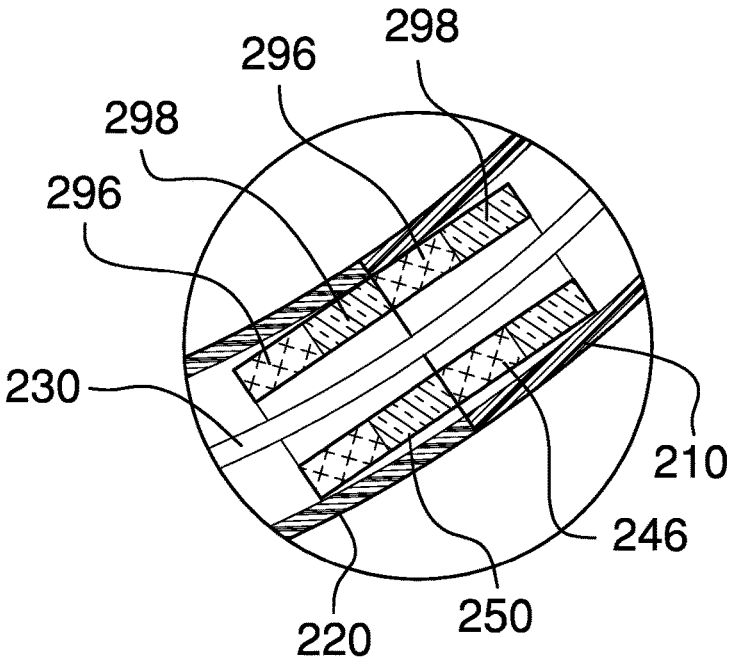
FIG. 6 is a detail view of an embodiment of the disclosure, illustrating the area marked 6 in FIG. 3.
Figure 7:
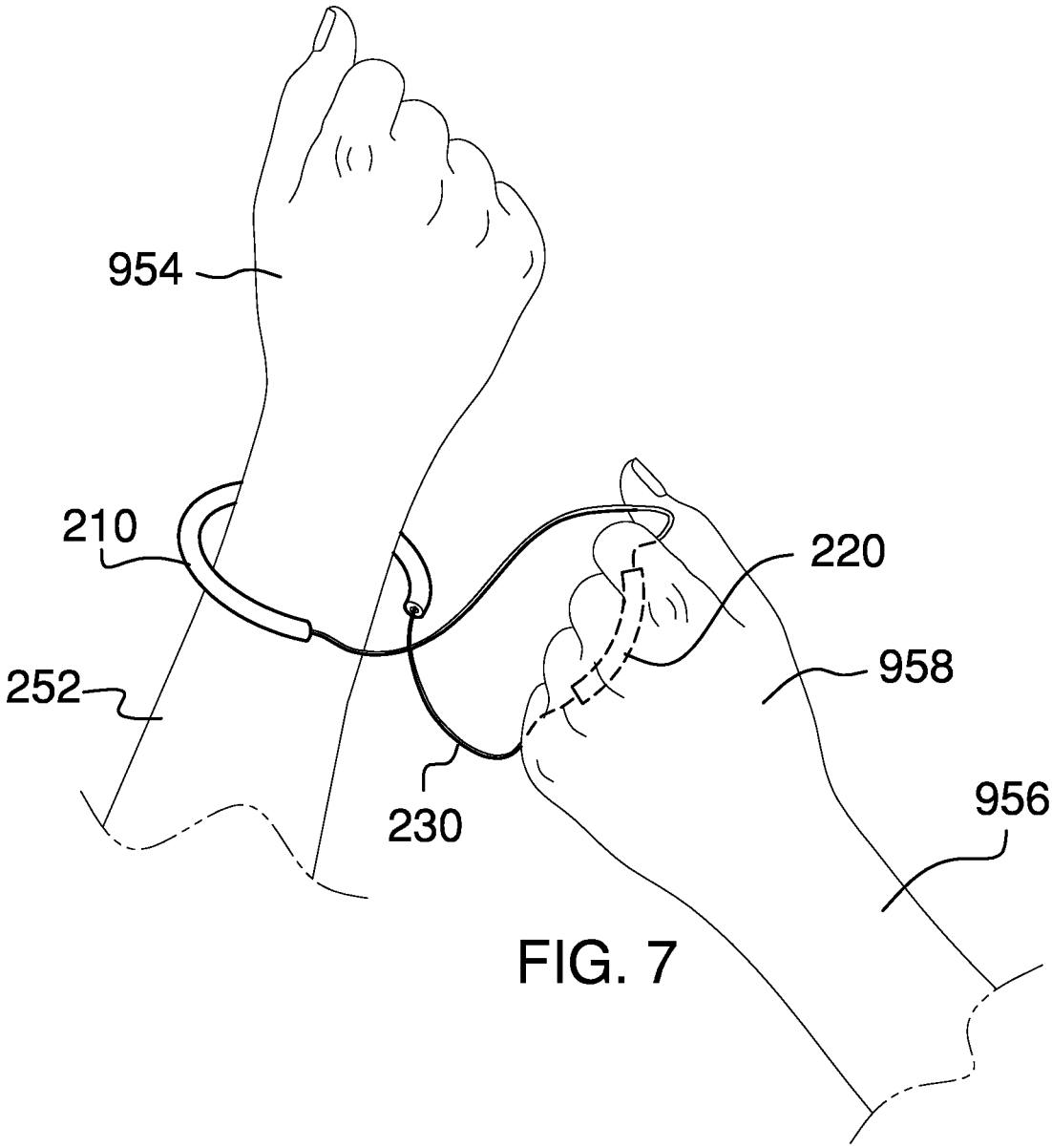
FIG. 7 is an in-use view of an embodiment of the disclosure.
Figure 8:
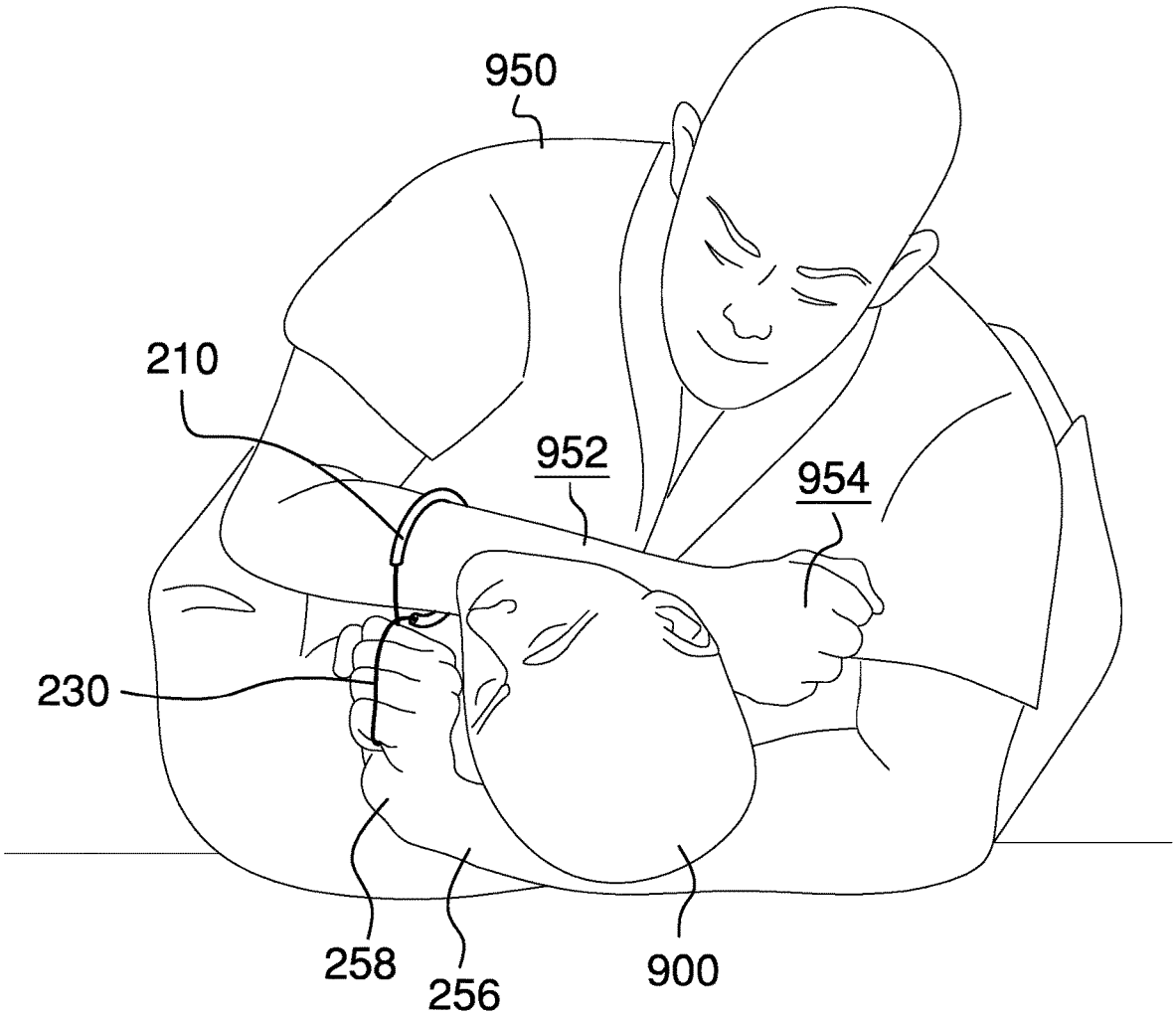
FIG. 8 is an in-use view of an embodiment of the disclosure.

Detailed reference will now be made to a first potential embodiment of the disclosure, which is illustrated in FIGS. 1 through 8.

The Ezekiel choke tool 100 (hereinafter invention) comprises a bracelet 200. The bracelet 200 may comprise a first segment 210, a second segment 220, a cord 230, and a plurality of magnets. The bracelet 200 may be adapted to be worn by a user on the user's first forearm 952 to facilitate a technique of Brazilian Jiu Jitsu called the Ezekiel Choke. In a 'separated configuration' 292, the second segment 220 may detach from the first segment 210 but may remain coupled to the first segment 210 by the cord 230. The bracelet 200 may be adapted to be leveraged by the user 950 to squeeze the opponent's throat between the user's first forearm 952 and the user's second forearm 956. In an 'attached configuration' 290, the bracelet 200 may encircle the user's first forearm 952, held together by the plurality of magnets.

The bracelet 200 may be a hollow torus. The bracelet 200 may be made of a durable, non-magnetic material. As non-limiting examples, the bracelet 200 may be made of polycarbonate, acrylic, high-density polyethylene, carbon-fiber reinforced polymer, non-magnetic stainless steel, aluminum, brass, titanium, tungsten, copper, zinc, or any combination thereof. The bracelet 200 may be one of a family of bracelets comprising a plurality of sizes. For proper fit, the size of the bracelet may be selected from the family of bracelets such that the bracelet circumference is 15 percent+/−5 percent larger than the wrist circumference.

The first segment 210 may be the larger section of the bracelet 200. The first segment 210 may subtend a first angle 222 having an apex at the center of the bracelet 200. The second segment 220 may be the smaller segment of the bracelet 200. The second segment 220 may subtend a second angle 224 having an apex at the center of the bracelet 200. The first angle 222 may be larger than the second angle 224.

The first segment 210 may comprise a first aperture 272 and a second aperture 274 that may be exposed in the 'separated configuration' 292. The second segment 220 may comprise a third aperture 276 and a fourth aperture 278 that may be exposed in the 'separated configuration' 292.

The first segment 210 and the second segment 220 may align to form the 'attached configuration' 290 of the bracelet 200. The first segment 210 and the second segment 220 may be held together by the plurality of magnets.

The first segment 210 and the second segment 220 may be separated to form the 'separated configuration' 292 of the bracelet 200. The first segment 210 may comprise a gap 212 created by the removal of the second segment 220. In some embodiments, the gap 212 may comprise a gap length 214 of 2.0 inches+/−0.5 inches.

Each of the plurality of magnets may be polarized. The north pole 296 of one magnet may be attracted to the south pole 298 of an adjacent magnet and may be repelled by the north pole 296 of the adjacent magnet. The cord 230 may pass through all of the plurality of magnets and may therefore define an ordering of the plurality of magnets. An individual magnet selected from the plurality of magnets is forward polarized if the north pole 296 of the individual magnet is closer to a first cord end 232 and the south pole 298 is closer to a second cord end 234 and is reverse polarized if the north pole 296 of the individual magnet is closer to the second cord end 234 and the south pole 298 is closer to the first cord end 232.

In a preferred embodiment, there may be a six magnets. A first magnet 242 and a second magnet 244 may be reverse polarized. A third magnet 246, a fourth magnet 248, a fifth magnet 250, and a sixth magnet 252 may be forward polarized.

The first magnet 242 may be located within the first segment 210 and may be moveable within the first segment 210. The first magnet 242 may be coupled to the first cord end 232. The second magnet 244 may be located within the first segment 210 and may be moveable within the first segment 210. The second magnet 244 may be coupled to the second cord end 234. The first magnet 242 and the second magnet 244 may define terminator magnets because the first magnet 242 and the second magnet 244 terminate the ends of the cord 230.

In the 'attached configuration' 290, the first magnet 242 and the second magnet 244 may be attracted to each other within the first segment 210 and the attraction between the first magnet 242 and the second magnet 244 may pull the cord 230 into the first segment 210. In the 'separated configuration' 292, the first magnet 242 may be positioned adjacent to the third magnet 246 and the second magnet 244 may be positioned adjacent to the fourth magnet 248. Repulsion between the first magnet 242 and the third magnet 246 and repulsion between the second magnet 244 and the fourth magnet 248 may assure that the terminator magnets may be free to move while transitioning from the 'separated configuration' 292 to the 'attached configuration' 290.

The third magnet 246 may be coupled to the first aperture on the first segment 210. The fourth magnet 248 may be coupled to the second aperture 274 on the first segment 210. The cord 230 may slidably pass through the center of the second magnet 244 and through the center of the third magnet 246.

The fifth magnet 250 may be coupled to the third aperture 276 on the second segment 220. The sixth magnet 252 may be coupled to the fourth aperture 278 on the second segment 220. The cord 230 may slidably pass through the center of the fifth magnet 250 and through the center of the sixth magnet 252. The fifth magnet 250 may detachably couple to the third magnet 246 to form a first coupling 280 between the first segment 210 and the second segment 220 and the sixth magnet 252 may detachably couple to the fourth magnet 248 to form a second coupling 282 between the first segment 210 and the second segment 220.

The cord 230 may be threaded through the first segment 210 and the second segment 220 such that the first cord end 232 and the second cord end 234 are position within the first segment 210. The first cord end 232 may be coupled to the first magnet 242 and may be prevented from pulling out of the first segment 210 by the third magnet 246. The second cord end 234 may be coupled to the second magnet 244 and may be prevented from pulling out of the first segment 210 by the fourth magnet 248. A cord length may be selected to permit the cord 230 to traverse the interior of the bracelet 200 such that the first magnet 242 and the second magnet 244 may attract each other within the first segment 210.

Those of ordinary skill in the art will recognize that the polarities of all of the plurality of magnets may be reversed and without departing from the spirit and scope of the present invention.

In use, a user 950 may wear the bracelet 200 on the user's first forearm 952. To apply the Ezekiel Choke, the user 950 may place the user's second forearm 956 behind the opponent's neck and may place the user's first forearm 952 in front of the opponent's throat. The user's first hand 954 may make a fist while the user's second hand 958 grasps the bracelet 200 and pulls the second segment 220 away from the first segment 210. The second segment 220 may remain in position on the user's first forearm 952 while the user's second hand 958 holds the first segment 210 with the cord 230 coupling the second segment 220 to the first segment 210. The user 950 may apply pressure to the opponent's throat by twisting the user's second hand 958 to pull the user's first forearm 952 down. The downward pressure against the opponent's trachea and/or the opponent's carotid artery may restrict blood flow and the supply of air and may therefore motivate an opponent 900 to yield.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" may be an opening in a surface or object. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used herein, the word "durable" may refer to a material's ability to withstand wear, pressure, impact, heat, cold, sun exposure, and other forms of potentially damaging conditions without suffering any significant deterioration of quality or value.

As used herein, "Ezekiel choke" may refer to a technique used in Brazilian Jiu-Jitsu that is intended to subdue an opponent by targeting the neck to restrict blood and air flow. The technique may be used in competition or for self-defense. There are different types of Ezekiel chokes—for example Gi and No-Gi based upon the clothing being worn. The basic technique is to place a first forearm across the front of the throat with that hand making a fist. A second forearm is placed behind the opponent's neck and the same hand grasps a gripping point on the first forearm. The gripping point may be a sleeve or the forearm itself. The second forearm twists to compress the opponent's neck tightly to apply pressure to the trachea, the carotid artery, or both. The technique may incapacitate the opponent within seconds.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, the word "interior" may be used as a relational term that implies that an object is located or contained within the boundary of a structure or a space.

As used in this disclosure, a "magnet" may be an ore, alloy, or other material that has its component atoms arranged so that the material exhibits properties of magnetism such as attracting iron-containing objects or aligning itself in an external magnetic field.

As used in this disclosure, a "torus" may be a surface of revolution generated by revolving a circle in three-dimensional space about an axis coplanar with the circle. If the axis of revolution does not touch the circle, the surface has a ring shape and is called a torus of revolution. Two or more tori that are merged together are referred to as an N hole torus where N is the number of apertures. In common usage, torus would refer to a one hole torus that is reminiscent of a donut shape. A "solid torus" may be formed by rotating a disc, rather than a circle, around an axis.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An Ezekiel choke tool comprising:

a bracelet;

wherein the bracelet comprises a first segment, a second segment, a cord, and a plurality of magnets;

wherein the bracelet is adapted to be worn by a user on the user's first forearm to facilitate a technique of Brazilian Jiu Jitsu called the Ezekiel Choke;

wherein in a 'separated configuration', the second segment detaches from the first segment but remains coupled to the first segment by the cord;

wherein the bracelet is adapted to be leveraged by the user to squeeze the opponent's throat between the user's first forearm and the user's second forearm;

wherein in an 'attached configuration', the bracelet encircles the user's first forearm, held together by the plurality of magnets.

2. The Ezekiel choke tool according to claim 1 wherein the bracelet is a hollow torus;

wherein the bracelet is made of a durable, non-magnetic material.

3. The Ezekiel choke tool according to claim 2 wherein the bracelet is made of polycarbonate, acrylic, high-density polyethylene, carbon-fiber reinforced polymer, non-magnetic stainless steel, aluminum, brass, titanium, tungsten, copper, zinc, or any combination thereof.

4. The Ezekiel choke tool according to claim 2 wherein the bracelet is one of a family of bracelets comprising a plurality of sizes;

wherein the size of the bracelet is selected from the family of bracelets such that the bracelet circumference is 15 percent+/−5 percent larger than the wrist circumference.

5. The Ezekiel choke tool according to claim 2 wherein the first segment is the larger section of the bracelet;

wherein the first segment subtends a first angle having an apex at the center of the bracelet.

6. The Ezekiel choke tool according to claim 5 wherein the second segment is the smaller segment of the bracelet;

wherein the second segment subtends a second angle having an apex at the center of the bracelet;

wherein the first angle is larger than the second angle.

7. The Ezekiel choke tool according to claim 6 wherein the first segment comprises a first aperture and a second aperture that are exposed in the 'separated configuration';

wherein the second segment comprises a third aperture and a fourth aperture that are exposed in the 'separated configuration'.

8. The Ezekiel choke tool according to claim 7
wherein the first segment and the second segment align to form the 'attached configuration' of the bracelet;
wherein the first segment and the second segment are held together by the plurality of magnets.

9. The Ezekiel choke tool according to claim 8
wherein the first segment and the second segment are separated to form the 'separated configuration' of the bracelet;
wherein the first segment comprises a gap created by the removal of the second segment.

10. The Ezekiel choke tool according to claim 9
wherein the gap comprises a gap length of 2.0 inches+/−0.5 inches.

11. The Ezekiel choke tool according to claim 9
wherein each of the plurality of magnets are polarized;
wherein the north pole of one magnet is attracted to the south pole of an adjacent magnet and is repelled by the north pole of the adjacent magnet;
wherein the cord passes through all of the plurality of magnets and therefore defines an ordering of the plurality of magnets;
wherein an individual magnet selected from the plurality of magnets is forward polarized if the north pole of the individual magnet is closer to a first cord end and the south pole is closer to a second cord end and is reverse polarized if the north pole of the individual magnet is closer to the second cord end and the south pole is closer to the first cord end.

12. The Ezekiel choke tool according to claim 11
wherein there are a six magnets.

13. The Ezekiel choke tool according to claim 12
wherein a first magnet and a second magnet are reverse polarized;
wherein a third magnet, a fourth magnet, a fifth magnet, and a sixth magnet are forward polarized.

14. The Ezekiel choke tool according to claim 13
wherein the first magnet is located within the first segment and is moveable within the first segment;
wherein the first magnet is coupled to the first cord end;
wherein the second magnet is located within the first segment and is moveable within the first segment;
wherein the second magnet is coupled to the second cord end;
wherein the first magnet and the second magnet define terminator magnets because the first magnet and the second magnet terminate the ends of the cord.

15. The Ezekiel choke tool according to claim 14
wherein in the 'attached configuration', the first magnet and the second magnet are attracted to each other within the first segment and the attraction between the first magnet and the second magnet pulls the cord into the first segment.

16. The Ezekiel choke tool according to claim 15
wherein in the 'separated configuration', the first magnet is positioned adjacent to the third magnet and the second magnet is positioned adjacent to the fourth magnet;
wherein repulsion between the first magnet and the third magnet and repulsion between the second magnet and the fourth magnet assures that the terminator magnets are free to move while transitioning from the 'separated configuration' to the 'attached configuration'.

17. The Ezekiel choke tool according to claim 16
wherein the third magnet is coupled to the first aperture on the first segment;
wherein the fourth magnet is coupled to the second aperture on the first segment;
wherein the cord slidably passes through the center of the second magnet and through the center of the third magnet.

18. The Ezekiel choke tool according to claim 17
wherein the fifth magnet is coupled to the third aperture on the second segment;
wherein the sixth magnet is coupled to the fourth aperture on the second segment;
wherein the cord slidably passes through the center of the fifth magnet and through the center of the sixth magnet;
wherein the fifth magnet detachably couples to the third magnet to form a first coupling between the first segment and the second segment and the sixth magnet detachably couples to the fourth magnet to form a second coupling between the first segment and the second segment.

19. The Ezekiel choke tool according to claim 18
wherein the cord is threaded through the first segment and the second segment such that the first cord end and the second cord end are position within the first segment;
wherein the first cord end is coupled to the first magnet and is prevented from pulling out of the first segment by the third magnet;
wherein the second cord end is coupled to the second magnet and is prevented from pulling out of the first segment by the fourth magnet.

20. The Ezekiel choke tool according to claim 19
wherein a cord length is selected to permit the cord to traverse the interior of the bracelet such that the first magnet and the second magnet attract each other within the first segment.

* * * * *